US005480680A

United States Patent [19]

Vieyra

[11] Patent Number: 5,480,680

[45] Date of Patent: Jan. 2, 1996

[54] METHOD FOR REFINISHING WOOD

[75] Inventor: Todd T. Vieyra, Jonesboro, Ga.

[73] Assignee: Furniture Medic, Inc., Forest Park, Ga.

[21] Appl. No.: 119,331

[22] Filed: Sep. 9, 1993

[51] Int. Cl.[6] ..... B05D 5/06; B05D 1/36

[52] U.S. Cl. ..... 427/388.4; 427/140; 427/267; 427/393; 427/408

[58] Field of Search ..... 427/393, 140, 427/408, 262, 267, 388.4

[56] References Cited

U.S. PATENT DOCUMENTS

| | | | |
|---|---|---|---|
| 2,829,067 | 8/1958 | Eastland | 427/408 |
| 3,017,287 | 1/1962 | Berry et al. | 427/408 |
| 3,829,323 | 8/1974 | Kirch | 427/262 |
| 3,887,940 | 6/1975 | Mangold et al. . | |
| 3,914,463 | 10/1975 | Mercurio et al. | 427/393 |
| 4,025,663 | 5/1977 | Brandt | 427/393 |
| 4,089,828 | 5/1978 | Guevatta et al. . | |
| 4,168,255 | 9/1979 | Lewis et al. | 427/393 |
| 4,191,796 | 3/1980 | Eckhoff | 427/408 |
| 4,197,219 | 4/1980 | Damico | 427/388.3 |
| 4,313,976 | 2/1982 | Leach | 427/440 |
| 4,430,367 | 2/1984 | Lat | 427/388.4 |
| 4,432,797 | 2/1984 | Vasishth et al. | 427/393 |
| 4,600,440 | 7/1986 | Vasishth et al. | 106/211 |
| 4,699,807 | 10/1987 | Howell | 427/140 |
| 4,722,854 | 2/1988 | Cope | 427/408 |
| 4,913,972 | 4/1990 | Grunewalder | 427/408 |
| 4,923,760 | 5/1990 | Adkins et al. | 427/393 |
| 5,089,313 | 2/1992 | Cope | 427/262 |
| 5,089,342 | 2/1992 | Dhein et al. | 427/393 |
| 5,141,784 | 8/1992 | Beane et al. | 427/393 |
| 5,219,616 | 6/1993 | Klostermann et al. | 427/393 |
| 5,242,490 | 9/1993 | Maner | 427/393 |

OTHER PUBLICATIONS

The Colour Index, 2d Edition Supplement, pp. S 14, (Society of Dyers and Colourists, Yorkshire England, 1963) (no month available).

The colour Index, 3rd Edition, pp. 1001–1002, 1022, 1244, 1057, 4009–4013, 4055–4057, (Society of Dyers and Colourists, Yorkshire, England, 1971) (no month available).

The Colour Index, 3rd Edition, First Supplement, pp. 6397 (Society of Dyers and Colourists, Yorkshire, England, 1979) (no month available).

The Colour Index, 3rd Edition, Third Revision, pp. 1965, 5002–5004, 5013, 8244, (Society of Dyers and Colourists, Yorkshire, England, 1987) no month available.

Encyclopedia Am., vol. 21, pp. 205–207 (1992) (no month available).

Encyclopedia Am., vol. 27, pp. 905 (1992) (no month available).

Encyclopedia Brit., 15th Ed., vol. 21, pp. 365–370, 384 (1992) (no month available).

Encyclopedia Brit., 15th Ed., vol. 9, p. 66 (1992) (no month available).

Flexmer, B., "Understanding Wood Finishing," Rodale Press, Pa., pp. 188–189 (1994) (no month available).

Turner, G. P. A., Introduction to Paint Chemistry, Second Ed., pp. 84, 134–139, Chapman and Hall, London, (1980) (no month available).

van Nostrand's Scienfific Encyclopedia, Seventh Ed., pp. 2117–2120 (1989) (no month available).

*Primary Examiner*—Diana Dudash
*Attorney, Agent, or Firm*—Kilpatrick & Cody

[57] ABSTRACT

A method is provided for effecting a color change in wood or a wood-grained article, and the article prepared thereby. The method includes the steps of applying to a nitrocellulose-finished wood article a composition that includes a water-based dye or pigment and a water-based varnish or lacquer over the nitrocellulose coating, without physically or chemically stripping the nitrocellulose layer. In an alternative embodiment, a wood-grained article is refinished by application of the water-based dye or pigment and a water-based varnish or Lacquer to its surface.

7 Claims, No Drawings

METHOD FOR REFINISHING WOOD

BACKGROUND OF THE INVENTION

The present invention is in the field of wood restoration, and more particularly is a method for imparting a color change to finished articles of wood or wood-grained materials, and the articles produced thereby.

Wood is typically finished in a process that involves coloring the wood with a stain or dye and then coating the colored wood with a protective sealer. Protective coating compositions that are used to finish articles of wood include linseed oil, mineral oil, tung oil, Danish oil, shellac, lacquer (nitrocellulose or water-based), phenolic-resin varnish (spar varnish), polyurethane varnish, water-based varnish, enamel, and wax. Each composition possesses different characteristics of gloss, quickness of drying, resistance to heat, water, alcohol, and other chemicals, ease of application and clean-up, and compatibility with other finishes. In addition, each reacts differently to hardwood and softwood as well as to the characteristics of individual articles of wood.

Nitrocellulose is strongly preferred by professional finishers and furniture factories as the protective coating for wood articles. In fact, most furniture currently manufactured commercially has a nitrocellulose top coating. Nitrocellulose is a strong, clear, quick-drying finish in both its sprayed and brushed form. It is quite durable, and can be polished to a high gloss. These characteristics, despite its noxious fumes and high flammability, have made it the most widely used finish in refinishing shops and furniture factories since the 1930's.

It is common practice to change the color of a wood or wood-grained article after it has been finished or already used. Even if the finish is undamaged, effecting a color change generally involves stripping the article down to bare wood, and beginning the finishing process anew. For an article originally finished with nitrocellulose lacquer, this involves either physical stripping operations, or chemical stripping that generally includes the use of organic solvents, for example, acetone or methylene chloride.

After the article has been stripped of its original finish, the desired color change is usually effected by dyeing the article with a water, oil, or alcohol based aniline dye. These dyes are absorbed by the wood fibers, and if water-based, may raise the grain of the wood, necessitating a further sanding operation. Aniline dyes have the disadvantage that they commonly fade on exposure to light. After dyeing, the article is finished, and optionally sealed, using any of a variety of compatible sealers and finishes known to those skilled in the art.

Effecting a color change in a finished article of wood thus currently requires the tedious, time-consuming, and hazardous operations of stripping off the existing nitrocellulose finish, dyeing the wood, and applying a new coating. The equipment used in the stripping and recoloring operations must also be cleaned with an organic-based solvent, generating more hazardous waste that must be disposed. The organic solvents are now typically disposed of in publicly-owned treatment facilities or in industrial pretreatment facilities, increasing the burden on the water purification systems. The refinishing process often takes place at a refinishing plant or other site remote from the typical location of the furniture, because of the fumes and dust generated in the process.

it would be desirable to have a method to change the color of finished wood or a wood-grained article that does not involve the use of hazardous organic solvents, and thus the generation of organic fumes and that can be carried out without moving the furniture to a remote location. It would also be of benefit to have a method for effecting a color change in wood, or a wood-grained article in particular, that has been finished with a nitrocellulose lacquer that does not require the step of chemical or physical stripping of the original finish. It would further be very useful to have a method for effecting a color change in wood or a wood-grained article in which the original wood grain remains visible through the newly applied color layer.

It is therefore an object of the present invention to provide a means for effecting a color change in wood or a woodgrained article.

It is a further object of the present invention to provide a means for effecting a color change in an article of wood without stripping off an original nitrocellulose finish.

It is another object of the present invention to provide a means for effecting a color change in wood or a wood-grained article in which the original wood grain remains visible through the newly applied color layer.

It is a further object of the present invention to provide a means for converting an original finish to a pickled, or white-wash, finish.

It is another object of the present invention to provide a means for refinishing wood or a wood-grained article that does not require the use of organic solvents.

SUMMARY OF THE INVENTION

A method is provided for effecting a color change in wood or a wood-grained article, and the article prepared thereby. The method includes the steps of applying to a nitrocellulose-finished wood article a composition that includes a water-based dye or pigment and a water-based varnish or lacquer over the nitrocellulose coating, without physically or chemically stripping the nitrocellulose layer. In an alternative embodiment, a wood-grained article is refinished by application of the water-based dye or pigment and a water-based varnish or lacquer to its surface, The method is an advance in the art of wood or wood-grain refinishing, in that the color of the wood is lightened or darkened in a manner in which the original wood remains visible through the new layer of color, and the process does not require the use of noxious organic solvents. The process can be easily carried out in a refinishing plant or at the site of the normal location of the furniture, including in a residential location.

Since the refinishing compositions described herein are water-based, clean-up is effected simply by washing all application instruments with tapwater.

The result of the refinishing process described herein can be dramatic, in that the color of the wood is significantly altered (lightened or darkened) without chemical or physical stripping, yet the natural beauty of the wood remains. The refinishing process can also be used to apply a fresh coating of the original color to the wood or wood-grained article, to mask wear marks or discolorations. In one embodiment, the wood or wood-grained article is refinished to a lighter shade, such as a pickled-type finish or a white wash finish. The pickled-type finish can have any desirable hue, including green or red.

All of the embodiments of the invention can be carried out without removing the original nitrocellulose finish of the wood, and without applying a new nitrocellulose finish.

DETAILED DESCRIPTION OF THE INVENTION

The term "wood" or "wood article," as used herein, includes all hardwoods and softwoods that are or could be utilized in the construction of furniture, cabinets, or other wooden objects. Softwoods that can be colored using this process include silver Fir, Queensland kauri, parana pine, hoop pine, cedar of Lebanon, yellow cedar, rimu, larch, Norway spruce, sitka spruce, sugar pine, Western white pine, Ponderosa pine, yellow pine, European redwood, Douglas fir, sequoia, yew , Western red cedar, and Western hemlock. Hardwoods that can be colored using this process include, but are not limited to Australian blackwood, European sycamore, soft maple, hard maple, red alder, goncalo alves, yellow birch, paper birch, boxwood, silky oak, pecan hickory, American chestnut, sweet chestnut, blackbean, satinwood, kingwood, Indian rosewood, Brazilian rosewood, cocobolo, ebony, Queensland walnut, utile, jarrah, American beech, European beech, American white ash, European ash, ramin, lignum vitae, bubinga, Brazilwood, butternut, American walnut, European walnut, American whitewood, balsa, purpleheart, afrormosia, European plane, American sycamore, American cherry, African padauk, American white oak, Japanese oak, European oak, American red oak, red lauan, Brazilian mahogany, teak, basswood, lime, obeche, American white elm, and Dutch/English elm.

The commercially important hardwoods include oak, mahogany, walnut, teak, maple, birch, beech, ash, elm, rosewood, sycamore, afrormosia, makore, and obeche. The commercially important softwoods include pine, Douglas fir, and western red cedar. The most popular woods used in furniture finishing and refinishing processes are oak, maple, walnut, Pine, Birch, cherry, ash, mahogany, beech, poplar, teak, pecan, elm, rosewood, fir, redwood, cedar, sycamore, butternut, and basswood.

The term "wood-grained article" as used herein, refers to any article that has a wood-grain impression on its surface, including, but not limited to a plastic article, a cardboard article, plywood, blockboard, particle board, fiber board, a paper-finished article, or photo-finished article, for example, on chipboard or other board.

As used herein, the term "lacquer" means a film-forming solution, dispersion, or suspension which dries by solvent evaporation. It may contain various natural or synthetic resins, varnishes, or polymers. As used herein, the term "water-based lacquer" means a lacquer whose primary solvent is water. As used herein, the term "nitrocellulose-based lacquer" means a lacquer which contains nitrocellulose.

As used herein, the term "varnish" refers to an organic-based film-forming solution, dispersion, or suspension which dries by solvent evaporation to form a typically transparent protective coating. A water-based varnish is a varnish that contains water as its primary solvent.

The term "water based" includes aqueous solutions, suspensions, dispersions and emulsions.

As used herein, the term "dye" refers to a soluble or insoluble coloring matter. Dyes are typically organic colorants derived from coal tar or petroleum-based intermediates. Dyes can be neutral, acidic, or basic. The chemical classes of coloring materials, their aqueous solubilities, and arrangement according to chemical structure have been set out in *The Colour Index,* 3rd Edition (Society of Dyers and Colourists, Yorkshire, England 1971) (and supplements), incorporated herein by reference.

As used herein, a "dispersed dye" is a dye whose solubility is small, and is dispersed rather than completely dissolved in the medium.

As used herein, a "pigment" is a colorant that does not dissolve, but is suspended in a medium to produce an opaque color. Pigments include whiting, barytes, clays, and talc. Pigments can be: (a) inorganic, for example, metallic oxides (iron, titanium, zinc, cobalt, chromium); metal powder suspensions (gold, aluminum); earth colors (siennas, ochers, umbers); lead chromates; and carbon black; or (b) organic, for example, animal (rhodopsin, melanin); vegetable (chlorophyll, xanthophyll, indigo, flavone, carotene); and synthetic (phthalocyanine, lithos, toluidine, para red, toners, lakes, etc.)

A method is provided for effecting a color change in wood or a wood-grained article, and the article prepared thereby. The method includes the steps of applying to a finished article of wood or a wood-grained article a composition that includes a water-based dye or pigment and a water-based varnish or lacquer.

Coloring Agents

Any dye, or mixture of dyes, can be used in this process that is water soluble and provides a translucent coating of the desired shade. Dyes can be identified and sources of dyes located in The Colour Index, 3rd edition (Society of Dyers and Colourists, Yorkshire, England 1971) (and supplements). Examples of these dyes include water-soluble nitroso, nitro, azo, azoic, stilbene, diphenylmethane, triarylmethane, xanthene, acridine, quinoline, methine, thiazole, indamine, indophenol, azine, oxazine, thiazine, sulfur, lactone, aminoketone, hydroxyketone, anthraquinone, indigoid, phthalocyanine, natural, oxidation bases, inorganic coloring matters, and combinations thereof. In a preferred embodiment, a dye is selected that is compatible with the water-based varnish or lacquer and that does not fade significantly when exposed to ultra-violet (UV) light. Basic aniline powders that are typically used to color wood can be used for this process, but are not preferred because of their poor UV-resistivity.

It has been discovered that a group of water-soluble coal tar dyes that have typically been used to change the color of carpets can be used to impart a color change to nitrocellulose-finished wood, and the color imparted can be both translucent and resistant to fading by ultra-violent rays. These dyes can be purchased commercially from Crompton and Knowles Corporation (Woodfield Industrial Park, Dalton, Ga.). Examples of preferred mixes of coloring agents that provide maple, golden oak, brown walnut, green walnut, and red mahogany are described in Table 1. Identifying information for the five dyes used in the formulations is provided in Table 2. Other dyes within the same general class, including, but not limited to, chromium, intralen-type, and nylanthrene-type, dyes can be easily identified by one of skill in the art or by inquiry to Crompton and Knowles Corporation.

The water-based dye is typically supplied in a concentrated form with appropriate solubilizing agents based on the chemical nature of the dye. Common solubilizing agents include, but are not limited to dialkylene glycol mono- or di-(alkyl ether), for example, diethylene glycol methyl ether, diethylene glycol monobutyl ether, alkanolamines, including diethanolamine, and propylene glycol. Other solubilizing agents can be used that do not adversely affect the performance of the dye in combination with the water-based varnish or lacquer. Appropriate acids or bases can also be used to adjust the pH as necessary or desired. The concentration of the dye in a commercial liquid product, such as that provided in Table 2, is often presented as a percentage of the strength of a standard powder formulation.

Alternatively, a pigment can be used as the coloring agent. In a preferred embodiment, while the pigment is opaque, it is used in a sufficient amount that the grain of the article remains visible through the coating. An example of a suitable pigment is Proline PL, which is a concentrated pigment available in multiple colors, including yellow, red, and green, from Engelhard Corporation (Iselin, N.J.).

Table 1

QUICK DRI COLOR FORMULAS*

O. D. C. Maple
- 87.719%—Intralan Yellow NW Liquid
- 10.965%—Nylanthrene Red GN Liquid
- 1.316%—Intralan Dark Blue M-BR Liquid O. D. C. Golden Oak
- 94.118%—Intralan Yellow NW Liquid
- 2.353%—Nylanthrene Red GN Liquid
- 1.411%—Intralan Dark Blue M-BR Liquid
- 2.118%—Intrachrome Black RPL Liquid O. D. C. Brown Walnut
- 67.416%—Intralan Yellow NW Liquid
- 16.854%—Nylanthrene Red GN Liquid
- 15.730%—Intrachrome Black RPL Liquid O. D. C. Green Walnut
- 48.780%—Intralan Yellow NW Liquid
- 36.585%—Nylanthrene Brilliant Yellow GN Liquid
- 14.635%—Intrachrome Black RPL Liquid O. D. C. Red Mahogany
- 44.101%—Intralan Yellow NW Liquid
- 39.361%—Nylanthrene Red GN Liquid
- 11.025%—Intralan Bordeaux RIB Liquid
- 5.513%—Intrachrome Black RPL Liquid AF

*Percentages are by weight with the balance water.

TABLE 2

COLORANTS IN QDC FORMULA

| NAME | CLASS | CI NAME | CI NO. |
|---|---|---|---|
| Intrachrome Black RPL 50%* | Acid Metal | — | None |
| Intralan Yellow NW L 25% | Neutral Metal | Acid Yellow #151 | 13906 |
| Intralan Dark Blue M-BR 40% | Neutral Metal | — | None |
| Nylanthrene Red 6N 33% Liquid | Acid | Acid Red #337 | 17102 |
| Nylanthrene Brilliant Yellow 4N6L 50% Liquid | Acid | Acid Yellow #49 | 18640 |
| Intralan Bordeaux RIB 50 RIB 50% Rar Liquid (Formerly Merpacyl by DuPont) | Neutral Metal | — | None |

*percent based on comparison to a powder strength, and is not an actual percent by weight

Water-based Varnish or Lacquer

Any water-based varnish or lacquer can be used in the coloring process that provides the desired effect. In selecting a varnish or lacquer, it is important to consider both its viscosity and its durability. If the viscosity of the lacquer or varnish is too thin, it is difficult to apply by pad, and if too thick, it is difficult to apply by spray. The durability of the finish is important because as the finish wears away during normal usage of the article, the newly applied color may also be removed. Water-based varnishes and lacquers are often acrylic-based resins or polyurethanes. The polyurethane imparts hardness to the composition and the acrylic polymer imparts flexibility to the composition.

A preferred lacquer is Flecto Diamond Finish, sold by Flecto, Inc. (Calif.). The lacquer is available in a clear or white formulation. Flecto Diamond Finish is believed to be an interpenetrating network of an acrylic polymer and a polyurethane polymer. This lacquer may be either padded on with a sponge, pad, rag, or other equivalent application instrument, or sprayed on. Flecto sells a cross-linking additive that can be mixed with its Flecto Diamond Finish to increase its durability, rendering it up to 50% more durable than a polyurethane lacquer. Other nonlimiting examples of lacquers which may be used in the coloring process include: Equal-Product, manufactured by Hydrocoat Finishing Products, which is suitable for both spraying and padding; EnviroPlus from Guardsman Products, Inc. (typically suitable for spray application only), and Finish-up by Mohawk, Inc. (typically suitable for pad application only). Water-based lacquer compositions are also described in U.S. Pat. No. 4,600,440 to Guevarra, et al., and U.S. Pat. No. 4,089,828 to Vasishth, et al., which are incorporated herein by reference.

Preparation of Coloring Composition

In a preferred embodiment, the water-based dye or pigment is added to the water-based varnish or lacquer in an amount that imparts a translucent color coating to the wood or wood-grain article upon application and such that the original grain remains visible after the refinishing process. It is also important that the concentration of the dye in the water-based varnish or lacquer be sufficiently low that it does not adversely affect the physical properties of the coating.

In a preferred embodiment, the proportion of water-based dye or pigment to water-based lacquer or varnish should not exceed 25% by volume, and preferably is 12% or less by volume. Given the disclosure herein, one of ordinary skill in the art can easily determine a specific ratio of components to achieve a desired effect.

When using one or a mixture of dyes described in Table in combination with the Flecto Diamond Finish water-based varnish, a ratio of approximately 1 ounce of dye to 16 ounces of water-based varnish or lacquer has been found suitable, however, other ratios may be used which fall within the scope of this invention.

When formulating a composition for a white wash finish, a suitable composition is 5 percent by weight of Proline PL concentrated pigment (Engelhard Iselin, N.J.), 15% by weight of Flecto Diamond Finish White and 80% by weight of Flecto Diamond Finish Clear. Again, other ratios may be used which fall within the scope of this invention.

For proper formulation, it is important that the concentrated dye have a pH that is compatible with the pH of the water-based varnish or lacquer. For example, if the dye is too acidic, it will not blend adequately with the Flecto Diamond Finish product. If a given ratio of dye or pigment to water-based varnish or lacquer results in a curdled or precipitated product, it has been found that a suitable coating composition can sometimes be achieved with the same formulation by lowering the dye concentration.

Application of the Composition to Wood or Wood-Grained Article

Prior to application of the coloring composition described above, the wood or wood-grained article should be cleaned so that oil or dirt on the surface of the article does not adversely affect the adherence of the composition to the article. This can be accomplished by washing the article with an organic solvent such as denatured alcohol, and then drying the article. Denatured alcohol dries without residue in a short period of time. Alternatively, a product that contains a terpene such as, for example, d-limonene extracted from orange peels, can be used to remove surface accretions resulting from the excessive oil and grease typically found in restaurants and kitchens.

Next, the surface of the wood or wood-grained article should be abraded to increase the adhesion of the new finish to the existing nitrocellulose finish. This may be effected by, for example, a light scuffing with a 3M ScotchBrite pad manufactured by 3M Corporation or a fine grade of sandpaper (preferably medium) or steel wool (preferably grade 5), followed by brushing off the grit or steel wool fragments with a clean, lint-free cloth.

The wood article should be thoroughly dried and dusted prior to application of the coloring composition. The water-based colorant/water-based lacquer-varnish compositions described herein can be applied by any suitable method, including by spraying or padding the composition onto the surface of the article to be refinished. For compositions of suitable viscosity, a preferred method of application is by means of a high-volume, low-pressure sprayer, such as the one manufactured by Croix Air Products, Inc. (South St. Paul, Minn.). This device is powered by a vacuum motor typically found in carpet cleaner machines. The equipment should be maintained in a very clean state so that it does not collect and distribute dust to the article that is being refinished. Another preferred method of application is by padding, such as with Contour Surface Pads, made by Easy Painter, Inc. These pads have small white filaments that hold a substantial amount of liquid, and thus do not require frequent resoaking. These pads provide a smooth, sprayed-on type finish.

When repairing an area of wood prior to application of the new color, the area to be repaired is first cleaned, as described above. After repair, then a nitrocellulose-based sanding sealer is applied to the area if the wood is bare, and allowed to dry. If the article is not completely dry prior to application of the water-based composition, the composition will flake off due to the presence of unevaporated solvents beneath it. The surface is then scuffed and the colorizing topcoat applied.

This invention has been described with reference to its preferred embodiments. Variations and modifications of the invention will be obvious to those skilled in the art from the foregoing detailed description of the invention. It is intended that all of these variations and modifications be included within the scope of the appended claims.

We claim:

1. A method for coloring nitrocellulose lacquer-finished wood with a surface wood grain that comprises applying to the wood a translucent layer of a composition that includes a water-based coloring agent and a water-based lacquer in such a manner that the surface wood grain is visible through the translucent layer, wherein the water-based coloring agent is selected from the group consisting of acid metal dyes, neutral metal dyes, Colour Index acid yellow Number 151, Colour Index acid red Number 337, Colour Index acid yellow Number 49, and combinations thereof.

2. The method of claim 1, wherein the water-based lacquer comprises an acrylic polymer.

3. The method of claim 1 wherein the water-based lacquer comprises a polyurethane.

4. The method of claim 1, wherein the wood is selected from the group consisting of hardwoods and softwoods.

5. The method of claim 1, wherein the wood is selected from the group consisting of oak, maple, walnut, birch, cherry, ash, mahogany, beech, poplar, teak, pecan, elm, rosewood, fir, redwood, cedar, sycamore, butternut, basswood, makore, obeche, and pine.

6. A method for coloring a wood-grained article with an existing nitrocellulose finish that comprises applying to the article a translucent layer of a composition that includes a water-based coloring agent and a water-based lacquer in such a manner that the surface wood grain is visible through the translucent layer, wherein the water-based coloring agent is selected from the group consisting of acid metal dyes, neutral metal dyes, Colour Index acid yellow Number 151, Colour Index acid red Number 337, Colour Index acid yellow Number 49, and combinations thereof.

7. The method of claim 6, wherein the article is selected from the group consisting of a plastic article, a cardboard article, plywood, blockboard, particle board, fiber board, a paper-finished article, and a photo-finished article.

* * * * *

UNITED STATES PATENT AND TRADEMARK OFFICE

CERTIFICATE OF CORRECTION

PATENT NO. : 5,480,680

DATED : January 2, 1996

INVENTOR(S) : Todd T. Vieyra

It is certified that error appears in the above-indentified patent and that said Letters Patent is hereby corrected as shown below:

Column 2, line 1, delete "it" and insert —It—.

Column 5, line 53, delete the first occurrence of "RIB 50".

Column 6, line 47, after the word "Table" insert the number —2—.

Signed and Sealed this

Twenty-ninth Day of July, 1997

Bruce Lehman

*Attest:*

BRUCE LEHMAN

*Attesting Officer*

*Commissioner of Patents and Trademarks*